US010453644B2

(12) United States Patent
Wang et al.

(10) Patent No.: US 10,453,644 B2
(45) Date of Patent: Oct. 22, 2019

(54) FIELD-EMISSION X-RAY SOURCE

(71) Applicant: Carestream Health, Inc., Rochester, NY (US)

(72) Inventors: Xiaohui Wang, Pittsford, NY (US); Michael K. Rogers, Mendon, NY (US)

(73) Assignee: Carestream Health, Inc., Rochester, NY (US)

( * ) Notice: Subject to any disclaimer, the term of this patent is extended or adjusted under 35 U.S.C. 154(b) by 372 days.

(21) Appl. No.: 15/346,761

(22) Filed: Nov. 9, 2016

(65) Prior Publication Data

US 2017/0148607 A1 May 25, 2017

Related U.S. Application Data

(60) Provisional application No. 62/340,131, filed on May 23, 2016, provisional application No. 62/263,167, filed on Dec. 4, 2015, provisional application No. 62/259,763, filed on Nov. 25, 2015.

(51) Int. Cl.

| | |
|---|---|
| ***H01J 35/20*** | (2006.01) |
| ***H01J 35/06*** | (2006.01) |
| ***H01J 9/39*** | (2006.01) |
| ***H01J 35/32*** | (2006.01) |

(52) U.S. Cl.

CPC ..... *H01J 35/20* (2013.01); *H01J 9/39* (2013.01); *H01J 35/065* (2013.01); *H01J 35/32* (2013.01); *H01J 2201/30469* (2013.01); *H01J 2235/062* (2013.01); *H01J 2235/205* (2013.01)

(58) Field of Classification Search

CPC ..... H01J 2201/30469; H01J 2235/062; H01J 2235/205; H01J 35/065; H01J 35/101; H01J 35/20; H01J 35/32; H01J 9/39

See application file for complete search history.

(56) References Cited

U.S. PATENT DOCUMENTS

| | | | | |
|---|---|---|---|---|
| 2,341,483 | A * | 2/1944 | Stephen | H01J 7/186 378/123 |
| 7,359,484 | B2 | 4/2008 | Qiu et al. | |
| 8,351,576 | B2 | 1/2013 | Behling et al. | |
| 8,509,385 | B2 | 8/2013 | Tang et al. | |
| 8,619,946 | B2 | 12/2013 | Hanke et al. | |
| 2001/0019601 | A1 | 9/2001 | Tkahashi et al. | |
| 2007/0183576 | A1* | 8/2007 | Burke | H01J 35/06 378/136 |
| 2010/0142680 | A1 | 6/2010 | August | |

(Continued)

FOREIGN PATENT DOCUMENTS

| | | |
|---|---|---|
| CN | 102427015 | 3/2014 |
| CN | 102427015 B * | 3/2014 |

(Continued)

OTHER PUBLICATIONS

EP Search Report, dated Apr. 21, 2017, EP Application No. 16 20 0119.2, 3 pages.

(Continued)

*Primary Examiner* — Chih-Cheng Kao

(57) ABSTRACT

An X-ray tube has a housing enclosing a vacuum chamber. There is a primary field-emission cathode within the vacuum chamber, a secondary cathode within the vacuum chamber, spaced apart from the primary cathode, and an anode target within the vacuum chamber.

10 Claims, 7 Drawing Sheets

(56) References Cited

U.S. PATENT DOCUMENTS

| | | | | |
|---|---|---|---|---|
| 2011/0038463 | A1* | 2/2011 | Behling | H01J 35/16 378/140 |
| 2016/0079029 | A1* | 3/2016 | Li | H01J 35/06 378/122 |
| 2016/0148777 | A1 | 5/2016 | Lan et al. | |

FOREIGN PATENT DOCUMENTS

| | | | | |
|---|---|---|---|---|
| WO | 2014180177 | | 11/2014 | |
| WO | WO-2014180177 | A1 * | 11/2014 | H01J 35/06 |

OTHER PUBLICATIONS

Z. Tolt et al., "Carbon Nanotube Cold Cathodes for Application in Low Current X-ray Tubes", J. Vac. Sci. Technol., B 26(2), 2008, pp. 706-710.

R. Parmee et al., "X-ray Generation Using Carbone Nanotubes", Springer Nano Convergence, 2015, pp. 1-27.

* cited by examiner

FIELD-EMISSION X-RAY SOURCE

CROSS REFERENCE TO RELATED APPLICATIONS

This application claims the benefit of U.S. Provisional U.S. Ser. No. 62/259,763, provisionally filed on Nov. 25, 2015, entitled "CARBON NANOTUBE (CNT) X-RAY SOURCE", in the names of Wang et al, which is incorporated herein by reference in its entirety.

This application claims the benefit of U.S. Provisional U.S. Ser. No. 62/263,167, provisionally filed on Dec. 4, 2015, entitled "CARBON NANOTUBE (CNT) X-RAY SOURCE", in the names of Wang et al, which is incorporated herein by reference in its entirety.

This application claims the benefit of U.S. Provisional U.S. Ser. No. 62/340,131, provisionally filed on May 23, 2016, entitled "FIELD-EMISSION X-RAY SOURCE", in the names of Wang et al, which is incorporated herein by reference in its entirety.

TECHNICAL FIELD

The invention relates generally to the field of medical imaging, and in particular to field-emission X-ray sources, such as carbon nanotube (CNT) X-ray sources.

BACKGROUND

X-ray imaging apparatus have been developed and improved, and are used in a range of applications for a number of 2D (2-dimensional) and 3D (3-dimensional) imaging modalities. In spite of numerous adaptations and ongoing redesign, however, there are some disappointing characteristics of the thermionic emission that is commonly used for X-ray generation. Conventional thermionic or heated-filament X-ray tubes, for example, are characterized by large size, high heat levels, and slow response time, constraining the design of more portable and flexible X-ray systems, including systems used for volume (3D) imaging.

As shown in the schematic diagram of FIG. 1, a traditional thermionic X-ray tube 10 based on the classical heated filament model includes an electron emitter having two metal electrodes formed within a vacuum tube 12. A cathode 14, typically a tungsten filament, is at one end of tube 12, and an anode 16 at the opposite end. The tungsten filament cathode 14 emits electrons when it is heated (for example, to 1,000 degrees C.). X-rays are excited and emitted through a window 18 when electrons internal to the tube are accelerated between the cathode 14 and a target 20, such as a tungsten target, on the anode 16 electrode. Thermionic emission (TE) devices of this type generate significant amounts of heat and often use a rotating anode and active cooling systems to help compensate for thermal effects.

By comparison to thermionic emission devices such as that shown in FIG. 1, field emission (FE) devices offer a number of advantages. FE devices are generally more compact. The field-emission process has thermal characteristics more favorable than those of conventional thermionic apparatus, with emission generated at ambient temperatures. FE devices generate X-rays using a tunneling process, with near-instantaneous emission, well suited to applications using pulsed X-ray emission.

As one type of FE source, carbon nanotubes (CNT) can be used as part of the cathode electrode in an X-ray tube. In place of the single tungsten emitter that provides the cathode for a conventional TE source, the FE device can use an array of structured carbon nanotubes as emitters. The nanotubes emit electrons from their tips instantly when a voltage is applied to them. The use of CNT emitters provides an arrangement that effectively operates as several hundred tiny electron guns that can be fired in rapid succession.

The use of carbon nanotube (CNT) based field emitters is advantaged for more compact design and improved FE behavior. The CNT X-ray sources are generally compact in design and can therefore be packaged closely together, allowing for X-ray source arrays with unique/particular geometries. CNT use enables the design of distributed X-ray sources for medical imaging applications.

There are, however, a number of fabrication hurdles for CNT devices. One problem relates to the need to precondition the X-ray tube components to remove ions that could cause damage to the cathode and shorten cathode working life if proper measures are not taken.

It would be desirable to have a fabrication process that reduces degradation to the cathode during manufacture of a CNT or other type of FE X-ray source.

SUMMARY

Certain embodiments described herein address the need for improved fabrication methods for CNT-based X-ray tubes. According to an embodiment of this disclosure, there is provided an X-ray tube comprising: a housing enclosing a vacuum chamber; a primary field-emission cathode within the vacuum chamber; a secondary cathode within the vacuum chamber, spaced apart from the primary cathode; and an anode target within the vacuum chamber.

These aspects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE EMBODIMENTS

Figure 1:
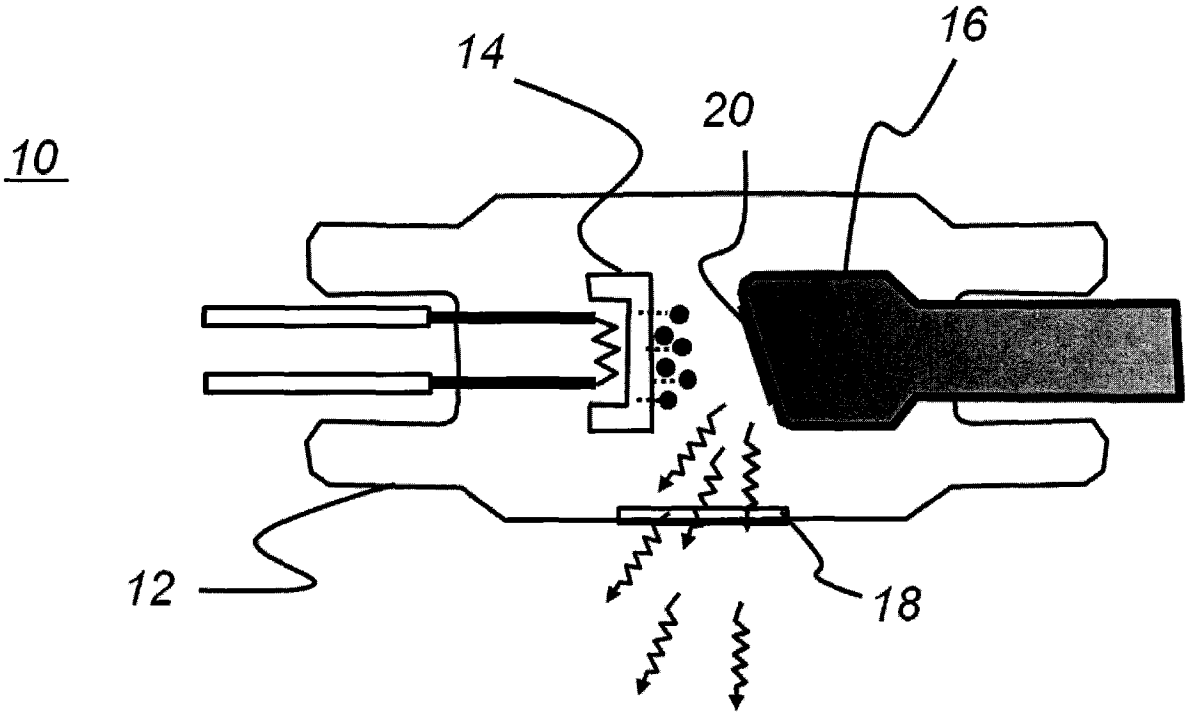
FIG. 1 is a simplified schematic of a conventional thermionic X-ray tube based on the thermionic electron emission model.

The following is a detailed description of embodiments of the invention, reference being made to the drawings in which the same reference numerals identify the same elements of structure in each of the several figures.

Where they are used in the context of the present disclosure, the terms "first", "second", and so on, do not necessarily denote any ordinal, sequential, or priority relation, but are simply used to more clearly distinguish one step, element, or set of elements from another, unless specified otherwise.

As used herein, the term "energizable" relates to a device or set of components that perform an indicated function upon receiving power and, optionally, upon receiving an enabling signal.

In the context of the present disclosure, the phrase "in signal communication" indicates that two or more devices and/or components are capable of communicating with each other via signals that travel over some type of signal path. Signal communication may be wired or wireless. The signals may be communication, power, data, or energy signals. The signal paths may include physical, electrical, magnetic, electromagnetic, optical, wired, and/or wireless connections between the first device and/or component and second device and/or component. The signal paths may also include additional devices and/or components between the first device and/or component and second device and/or component.

In the context of the present disclosure, the term "coupled" is intended to indicate a mechanical association, connection, relation, or linking, between two or more components, such that the disposition of one component affects the spatial disposition of a component to which it is coupled. For mechanical coupling, two components need not be in direct contact, but can be linked through one or more intermediary components.

Reference is made to U.S. Pat. No. 8,351,576 (Behling) and U.S. Pat. No. 8,509,385 (Tang).

As has been described in the background section of the present application, there is a desire to provide a field emission X-ray emitter tube using CNTs and to use methods that condition the anode and, more generally, reduce degradation of the CNT electrodes during manufacture.

Figure 2:
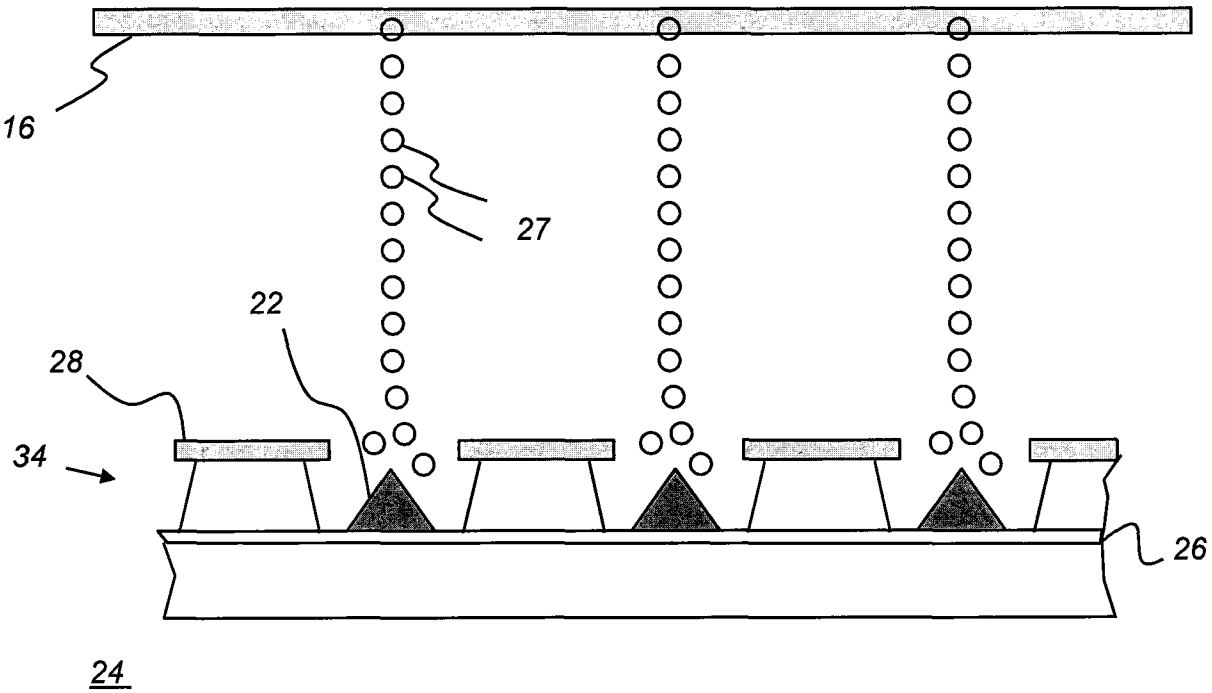
FIG. 2 is a schematic side view showing micro-emitters formed for CNT emission of electrons in a field-emission X-ray device.

FIG. 2 is a schematic side view showing electron beam formation in a field-emission X-ray device 24 using CNTs. In FE X-ray device 24, a cathode 34 with generally conical micro-emitters 22, also termed microtips, is formed onto a substrate 26 for CNT emission of electrons 27. Each micro-emitter 22 is formed using numerous hair-like CNT structures and has surrounding gating electrodes 28 that provide a DC voltage potential substantial enough to draw electrons 27 from the CNT material. Once freed, electrons 27 are then propelled by a higher voltage potential toward anode 16.

A CNT-based X-ray source can include a substrate having the emitter structure formed thereon as shown in FIG. 2 and, on top of the emitter structure, a focusing unit that consists of one, two or more focusing electrodes. A linear array of CNT based emitters 22 can be formed with appropriate placement of emitter and gating and focusing elements with an appropriate pitch in one or two dimensions. Various changes to the electrode arrangement can also be done to improve emission, such as providing a suitably sized hole in the gating electrode 28 on top of the emitting center of the substrate, for example. With suitable placement and modifications to the basic electrode arrangement, a one-dimensional array or two-dimensional array of electron-beam sources can thus be formed that selectively emits the electron beam onto a fixed (or possibly rotating) anode. Advantageously, the emission process can occur at room temperature. According to an alternate embodiment, the carbon nanotube emitting structures form a film on the primary cathode.

As described previously in the background section of the present application, replacing the thermionic TE cathode of a typical X-ray source with a CNT cathode that uses FE emission provides some benefits to existing X-ray tubes/sources. For example, the CNT X-ray source does not require high cathode temperatures and allows instantaneous turning on and off of the X-ray beam. This allows for fast image acquisition and physiological gating for medical applications.

There are, however, a number of fabrication problems that need to be overcome for CNT X-ray tube manufacture. References that describe various problems encountered in CNT fabrication are described, for example, in U.S. Pat. No. 7,359,484 (Qiu), U.S. Pat. No. 8,619,946 (Hanke), U.S. Pat. No. 8,351,576 (Behling), and "X-Ray Generation Using Carbon Nanotubes" by Parmee et al, Springer, 2015, all of which are incorporated herein by reference in their entirety.

One stage in fabrication of a CNT X-ray tube is preconditioning of the anode (target) and de-gassing of the X-ray tube. This processing helps to dramatically reduce the population of loosely bound positive ions within the vacuum tube. These particles could otherwise degrade the cathode and shorten the useful life of the CNT X-ray tube.

Using conventional fabrication practices, the X-ray tube is assembled and vacuum is then applied to begin evacuation of gases. As this proceeds, a high voltage is applied across the electrodes as vacuum is applied, providing high energy between the cathode and anode in order to de-gas the tube and condition the anode in progressive stages. However, generation of a voltage sufficient for de-gassing and anode conditioning can have some undesirable side effects and may degrade and/or damage the cathode due to arcing. The field-emission cathode formed using CNT devices can be particularly susceptible to damage where arcing occurs. Ions inadvertently generated from residual gas or vapor at the target can cause a shower of back-directed electrons that damage the cathode surface.

Applicants have recognized a need to fabricate a CNT X-ray source without degrading or damaging the CNT cathode during fabrication. Applicants have developed a fabrication method for a CNT X-ray tube wherein the CNT cathode is not damaged or its performance degraded, particularly if a high voltage is applied, such as during the de-gas/conditioning process. With the Applicants' method, a secondary cathode, spaced apart from the primary field-emission cathode, is employed. This secondary cathode is a sacrificial cathode, used only during the conditioning process instead of the primary cathode. Conditioning of the anode can thus be obtained using the secondary cathode. Any arcing that might occur between electrodes would have its effect on the sacrificial secondary cathode, rather than on the primary (i.e., CNT) cathode that is being conditioned.

Figure 3A:
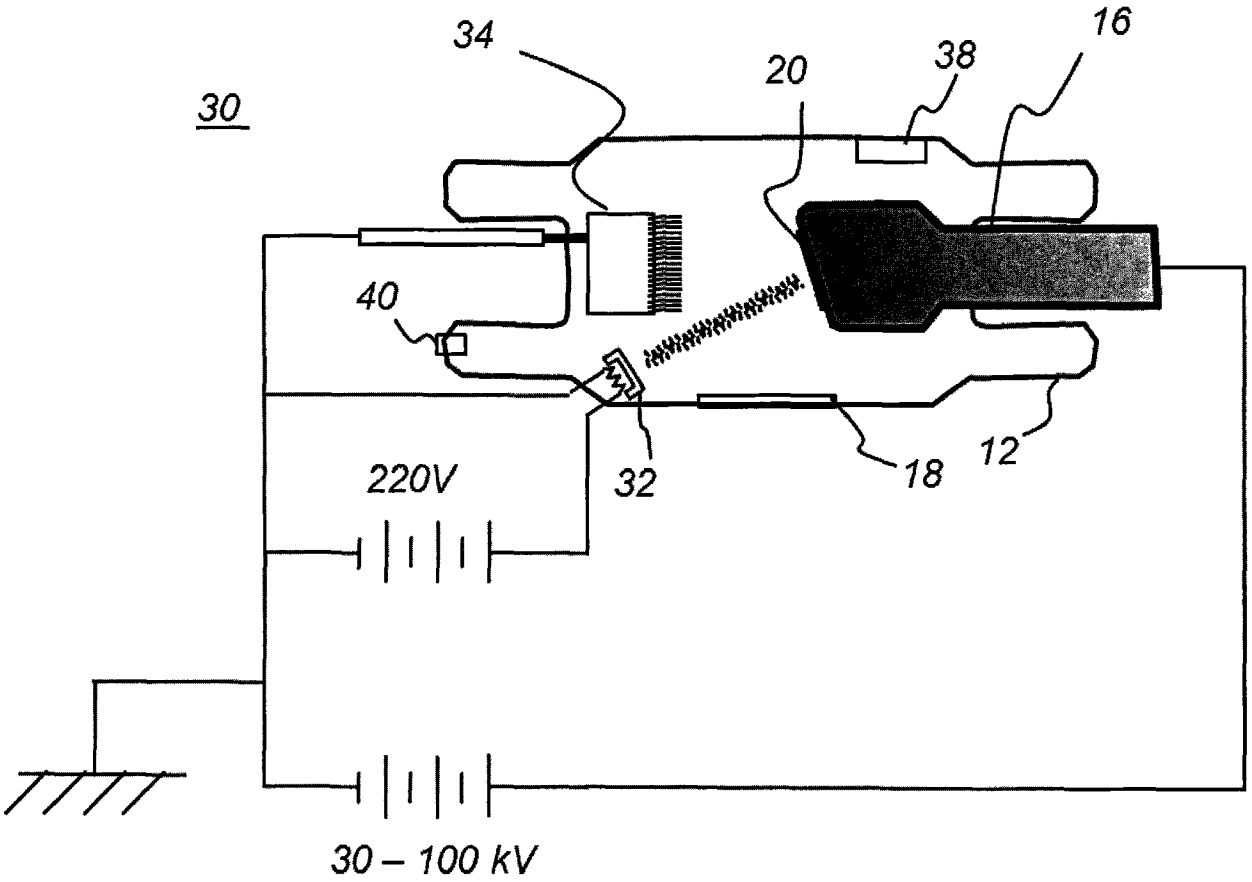
FIG. 3A is a simplified schematic that shows a field-emission X-ray tube, in accordance with the present disclosure, during de-gassing and anode conditioning as part of fabrication.
Figure 3B:
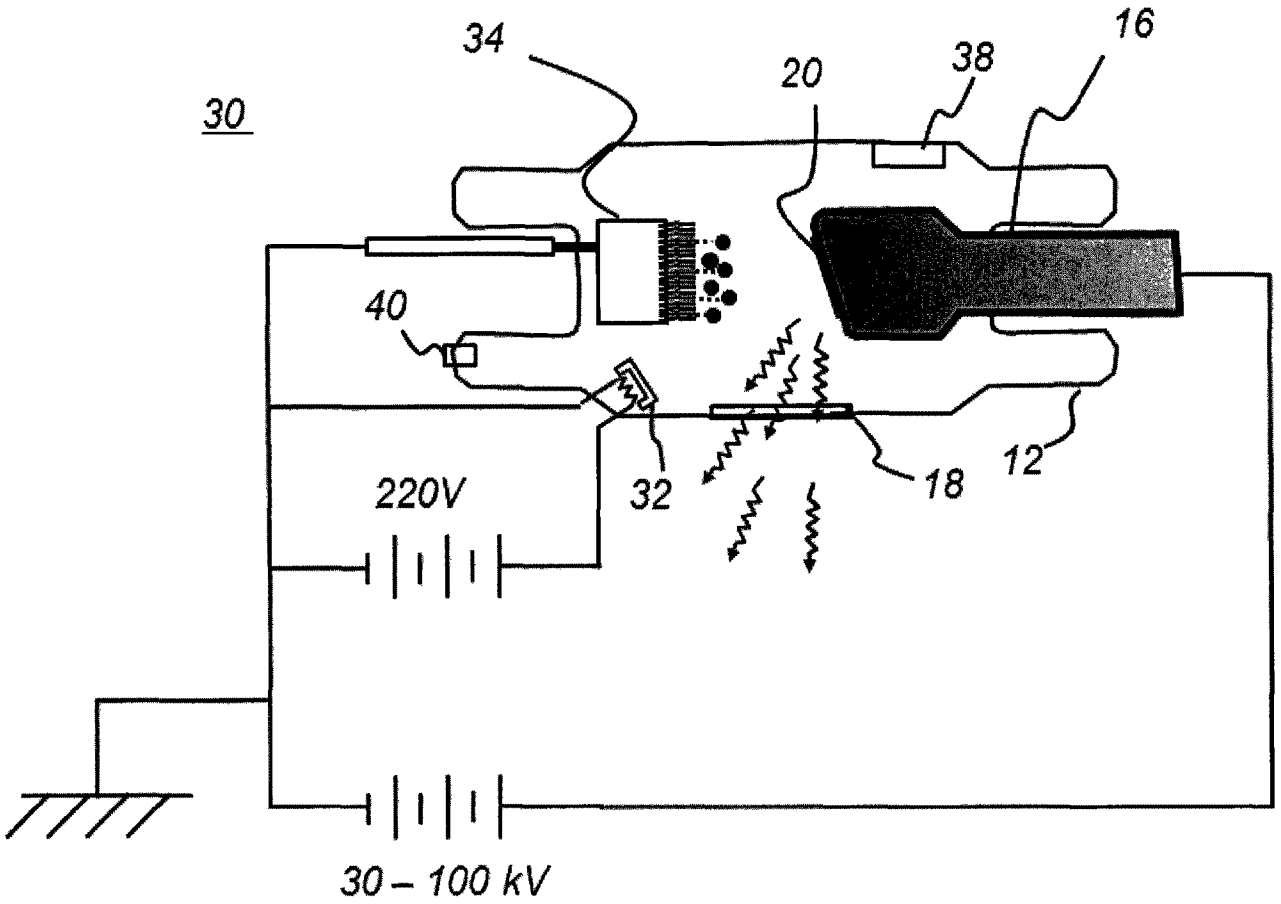
FIG. 3B is a simplified schematic that shows a field-emission X-ray tube, in accordance with the present disclosure, during operation.

The schematic diagrams of FIGS. 3A and 3B show components used in fabrication of an X-ray tube 30 according to an embodiment of the present disclosure. Within vacuum tube 12 are a primary field-emission cathode 34 having CNT structures formed thereon to provide electron emission that is directed to target 20 on anode 16. A secondary cathode 32 is provided for the conditioning process.

The secondary cathode 32 can be of any type. In a preferred embodiment, the secondary cathode is a less expensive component, selected for its durability and structure and able to withstand the requirements of the conditioning process. For example, secondary cathode 32 can be a typical thermionic cathode or typical filament cathode, such as a tungsten filament cathode. According to an alternate embodiment, however, it is noted that the secondary cathode 32 can also be a CNT cathode. In general, a thermionic secondary cathode, although thermionic emission may be less desirable for causing X-ray generation, has some useful strengths and advantages for robustness in the event of arcing during tube conditioning.

One or more optional ion getter elements 38 can be provided for attracting and dissipating loose ion particles during intervals between firings. Getter element 38 is typically formed from a gas-absorbent metal, such as strontium or zirconium, for example. The function of secondary cathode 32, offset from anode 16, is to support the degassing and anode conditioning processes during tube 30 fabrication. The primary cathode 34, opposing anode 16, is thus not employed during conditioning, extending its lifetime for X-ray emission functions. A vacuum port 40 is provided to allow gas evacuation during fabrication.

Referring to FIGS. 3A and 3B, fabrication of CNT X-ray tube 30 begins with assembly of components within the X-ray tube, a bake-out process, and evacuation of gases using vacuum. As vacuum continues to reduce the air content, the de-gassing and anode 16 conditioning can begin. Typically in incremental stages, increasingly higher voltages are pulsed to the secondary cathode 32 in order to effect degassing of the tube and anode conditioning. Arcing, which often occurs due to the presence of positive ions (cations) within the tube, can divert the electron beam from its intended path. Using the secondary cathode 32 the arcing extends between secondary cathode 32 and anode 16. Primary cathode 34 is not energized, so that arcing damage to this component is averted.

Once fabrication is complete, the vacuum port 40 is sealed, and voltage to the secondary cathode 32 is removed. There is no need to remove the sacrificial secondary cathode 32 from X-ray tube 30 since its location/position/presence within the X-ray tube chamber does not affect the function/operation of X-ray tube 30. The secondary cathode 32 is not disposed within a direct path between the primary cathode 34 and anode target 20. Thus, in operation for imaging, while located/existing within the X-ray tube, the secondary cathode 32 does not play any role in energizing CNT X-ray tube 30.

Figure 4:
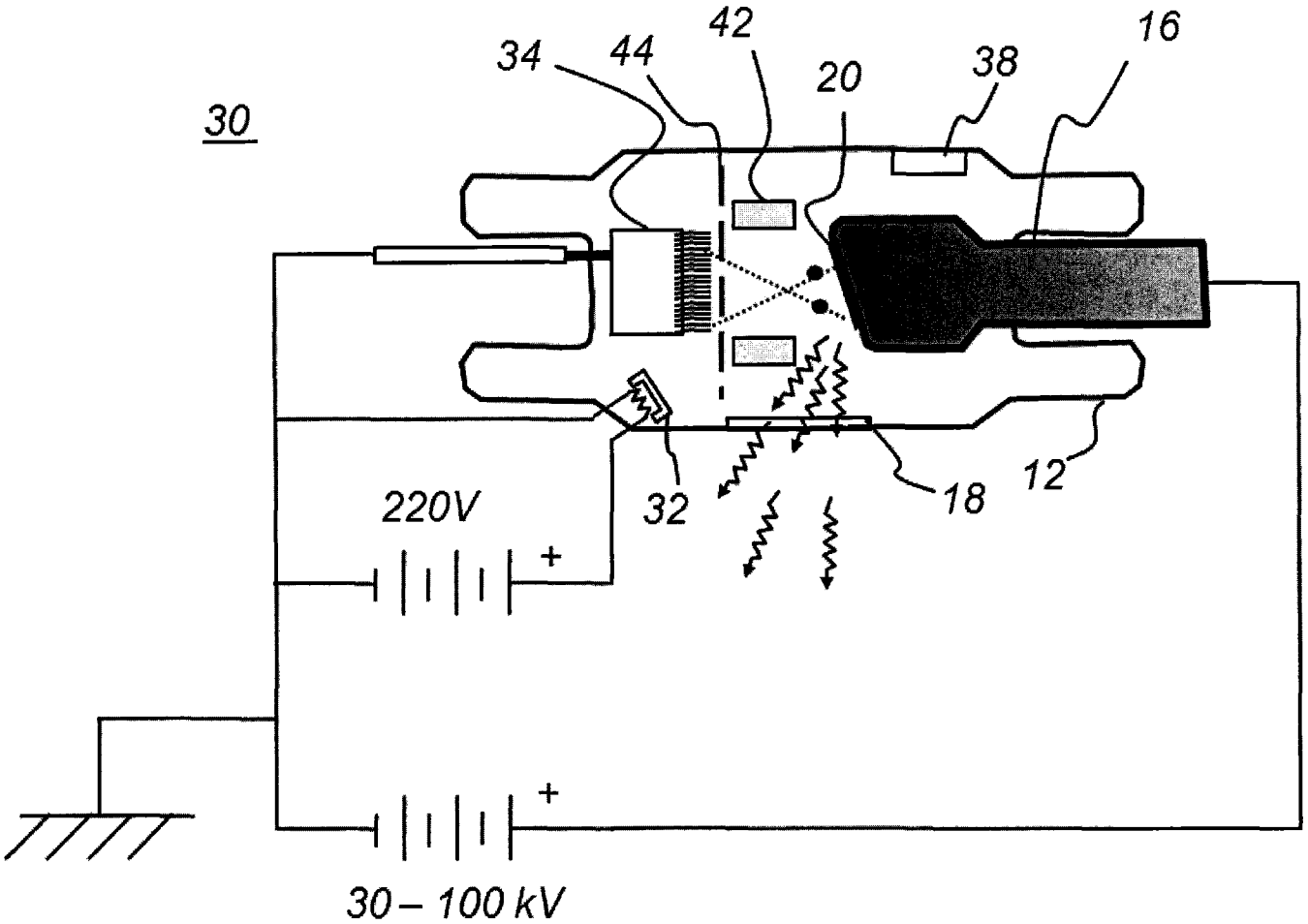
FIG. 4 is a simplified schematic that shows a field-emission X-ray tube, in accordance with the present disclosure, having additional components.
Figure 5:
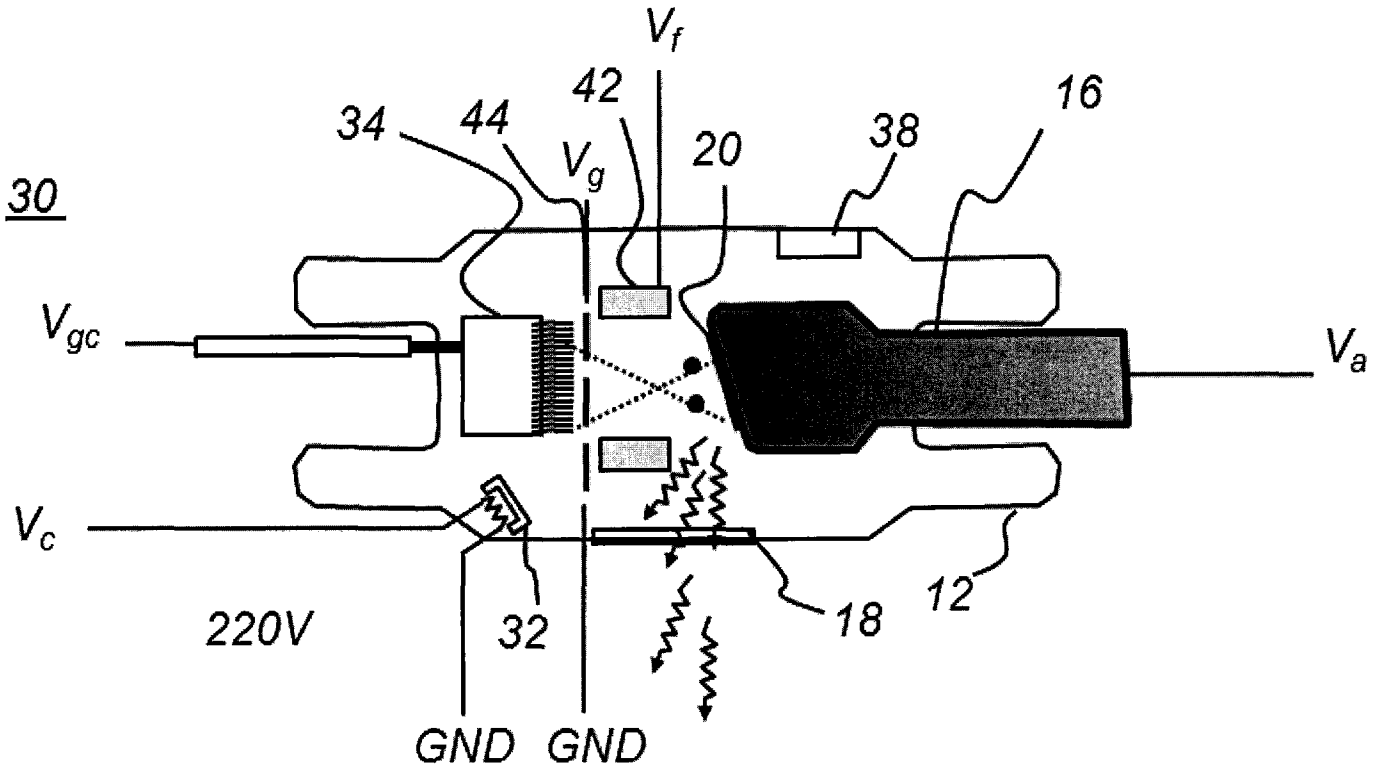
FIG. 5 is a simplified schematic that shows an X-ray tube, in an alternate embodiment of the present disclosure, having additional components.
Figure 6:
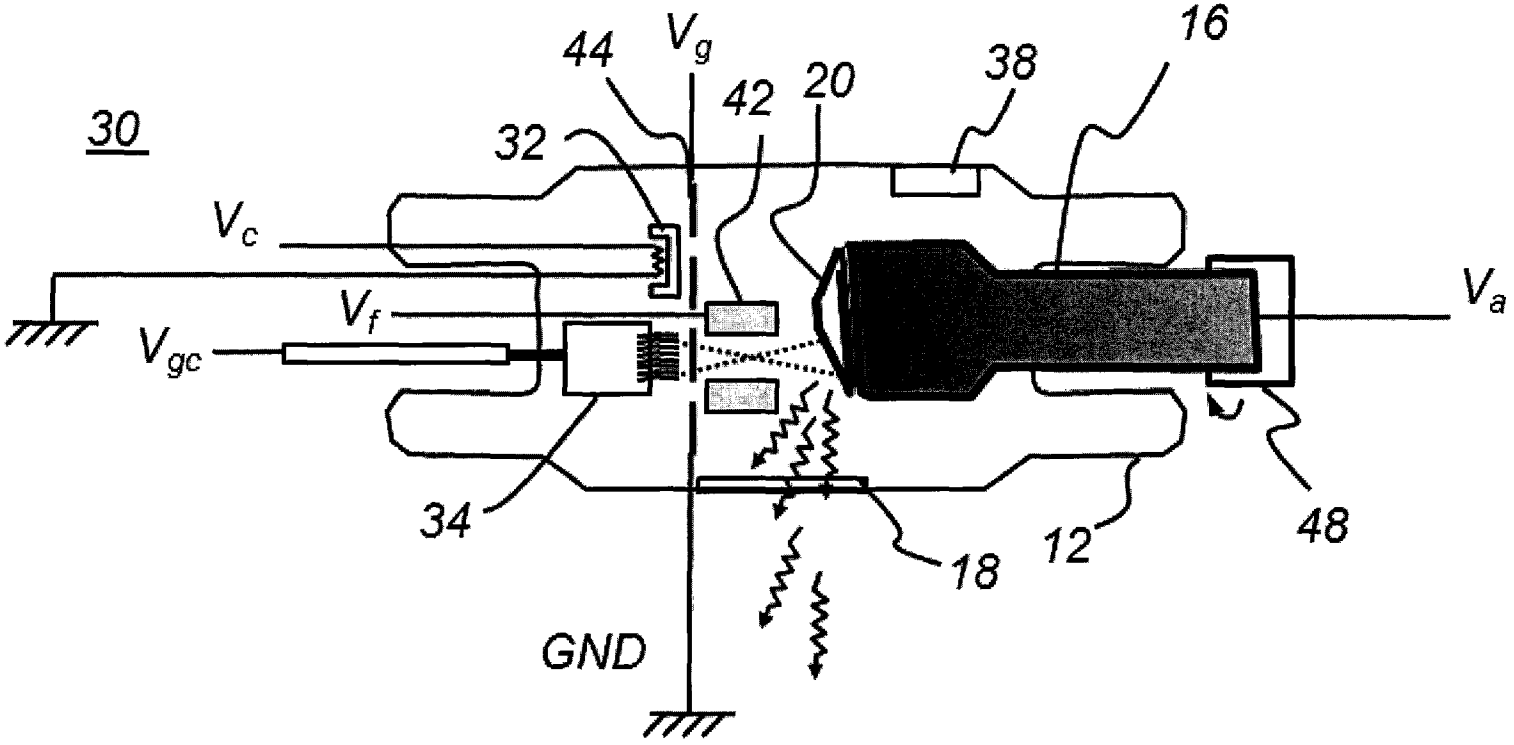
FIG. 6 is a simplified schematic that shows an X-ray tube, in accordance with the present disclosure, having a rotatable anode.

The schematic diagrams of FIGS. 4-6 show additional components that can be incorporated into X-ray tube 30, including a focus ring 42 or focus cup, controlled by a focus voltage $V_f$, or other focusing device, and a gate mesh 44, controlled by a gate voltage $V_g$. Anode voltage is shown as $V_a$; secondary cathode voltage is shown as $V_c$; primary cathode voltage is shown as $V_{gc}$. Other components that can be provided for providing suitable beam shape, focus, and related characteristics include various types of electrostatic optics, voltage gates, grids, additional passive ion getter elements, and the like. One or more such components can be included with the Applicants' X-ray tube (as described here) since the position/location of such other component(s) does not affect/intrude/interfere with the fabrication/operation of the Applicants' X-ray tube (as described herein). As shown in FIG. 6, an optional motor or other rotary actuator 48 can be provided to rotate the anode 16 for improved thermal distribution. One or more of the high voltage signals can be provided in a cable, such as a coaxial cable, for example.

It is noted that, if desired, the primary cathode 34 can be used in conjunction with secondary cathode 32 for some portion of tube 30 fabrication. In a preferred arrangement, the primary cathode 34 would only be used during fabrication in a limited, non-substantial manner, supporting the role of sacrificial secondary cathode 32 without adversely affecting the life, quality, operation, or function of the primary cathode 34 during its imaging operation.

Applicants have described an X-ray source comprising: a housing; a primary cathode; a secondary cathode; and an anode target. The X-ray tube can include a vacuum chamber disposed within the housing, wherein the vacuum housing houses the primary cathode, the secondary cathode, and the anode target.

In at least one arrangement, the primary cathode is a carbon nanotube cathode.

In at least one arrangement, the primary cathode is a carbon nanotube cathode and the secondary cathode is not a carbon nanotube cathode.

In at least one arrangement, the primary cathode is a carbon nanotube cathode and the secondary cathode comprises a tungsten filament.

In at least one arrangement, the primary cathode is spatially opposite the anode target and the secondary cathode is offset so that it is not directly opposite the anode target.

In at least one arrangement, the primary cathode is opposing the anode target; the secondary cathode is disposed intermediate the primary cathode and anode target; but the secondary cathode is not disposed within a direct path between the primary cathode and anode target.

In at least one arrangement, the X-ray tube further comprises a gate electrode, voltage gate, gate mesh, focus lens, optics, or the like to control the emissions of the primary cathode relative to the anode target.

In at least one arrangement, the X-ray tube further comprises one or more ion-getter elements disposed within the housing.

Applicants have described a method of fabricating an X-ray tube comprising a primary cathode, a secondary cathode, and an anode target, all of which are disposed within a housing, wherein the method comprises degassing/conditioning the anode target using solely the secondary cathode.

Applicants have described a method of fabricating an X-ray tube comprising a primary cathode, a secondary cathode, and an anode target, all of which are disposed within a housing, wherein the method comprises degassing/conditioning the anode target without using the primary cathode.

In the claims, the terms "first," "second," and "third," and the like, are used merely as labels, and are not intended to impose ordinal or numerical requirements on their objects.

The invention has been described in detail, and may have been described with particular reference to a suitable or presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. A method for X-ray tube fabrication comprising:

forming a primary cathode having carbon nanotube emitters;

forming a secondary cathode;

forming an anode;

fitting the anode, the primary cathode and the secondary cathode into a vacuum chamber, and positioning the secondary cathode away from a direct path between the primary cathode and the anode;

evacuating gaseous content of the vacuum chamber to form a vacuum tube containing the anode, the primary cathode and the secondary cathode; and conditioning the anode and de-gassing the vacuum tube by energizing the secondary cathode and not energizing the primary cathode during the step of evacuating.

2. The method of claim 1, further comprising forming the secondary cathode as a filament-based emitter.

3. The method of claim 1, further comprising rotating the anode during the step of evacuating.

4. The method of claim 1, further comprising forming the secondary cathode as a tungsten filament-based emitter.

5. The method of claim 1, further comprising forming a gating electrode, a voltage gate, or electrostatic optics and fitting the gating electrode, the voltage gate, or the electrostatic optics into the vacuum chamber prior to the step of evacuating to control an electron emission of the primary cathode toward the anode target during operation of the X-ray tube for imaging.

6. The method of claim 1, further comprising forming one or more ion-getter elements and fitting the one or more ion-getter elements into the vacuum chamber prior to the step of evacuating.

7. The method of claim 1, further comprising forming a rotary actuator, coupling the rotary actuator to the anode and fitting the rotary actuator into the vacuum chamber prior to the step of evacuating.

8. The method of claim 1, further comprising forming the carbon nanotube emitters as a film on the primary cathode.

9. The method of claim 1, further comprising forming at least one focusing element and fitting the at least one focusing element into the vacuum chamber prior to the step of evacuating to shape a beam of electrons emitted from the primary cathode during operation of the X-ray tube for imaging.

10. The method of claim 1, further comprising forming at least one element that assumes a charge and fitting the at least one element that assumes a charge into the vacuum chamber prior to the step of evacuating.

* * * * *